US006902216B1

(12) United States Patent
Peng

(10) Patent No.: US 6,902,216 B1
(45) Date of Patent: Jun. 7, 2005

(54) SUPPLEMENTARY STRETCHER FOR LAYING CARPET

(76) Inventor: Tzu-Ling Peng, P.O. Box 697, Feng-Yuan City, Taichung Hsien (TW), 420

( * ) Notice: Subject to any disclaimer, the term of this patent is extended or adjusted under 35 U.S.C. 154(b) by 0 days.

(21) Appl. No.: 10/754,519

(22) Filed: Jan. 12, 2004

(51) Int. Cl.[7] ..... E04F 21/20

(52) U.S. Cl. ..... 294/8.6; 254/200; 254/206; 254/209; 254/212

(58) Field of Search ..... 294/8.6; 254/200, 254/203, 206, 209, 212

(56) References Cited

U.S. PATENT DOCUMENTS 555,755 A * 3/1896 Bertram ..... 254/206
1,919,840 A * 7/1933 Hoobler ..... 294/8.6
3,547,479 A * 12/1970 Tasse ..... 294/8.6
5,190,328 A * 3/1993 Anderson ..... 294/8.6
6,039,371 A * 3/2000 Smith ..... 394/8.6
6,595,565 B2 * 7/2003 Whiting et al. ..... 294/8.6

* cited by examiner

*Primary Examiner*—Eileen D. Lillis
*Assistant Examiner*—Michael Lowe

(57) ABSTRACT

A supplementary stretcher for laying carpet includes a flat head having a plurality of tines on the underside protected by a cap and lug on rear end, a hollow interior handle having a downward arcuate front end pivoted to the lug of the head, a detent means in cooperation with an elastic plate disposed in a rear end of the handle, a sliding bar slidably inserted into the rear end of the handle having a plurality of serrations on the underside engageable with a retaining frame of the detent means and a pushing plate combined with a soft plate on outer surface and an inverse U-shaped member on inner surface pivoted to the rear end of the sliding bar with a spring engaged therebetween. The feature is that the handle is lengthily adjustable, the flat head and the pushing plate may slant a certain angle to correspond with the ergonomics. Besides, the flat head may be replaced with a sucking disk.

6 Claims, 11 Drawing Sheets

SUPPLEMENTARY STRETCHER FOR LAYING CARPET

BACKGROUND OF THE INVENTION

The present invention relates to lay in order the carpet on the floor or to pave a tile on the wall and more particularly to a supplementary stretcher for laying carpet which helps the worker to evenly lay in order a carpet on the floor without wrinkles.

To lay a carpet in order on a floor must be plane without any wrinkle. However, once the wrinkles are found during the laying stage. The worker has to pull the edge of the carpet in order to eliminate the wrinkles. But it is difficult to stretch the carpet with the hands of a worker standing aside a wall. That's why a supplementary stretcher available in the market to help the worker to stretch the wrinkles in laying a carpet. This type of supplementary stretcher is composed of a head with tines and a handle to enable the worker to grasp with his hands or to stop against the end of the handle with his knees to push the stretcher moving forward and to utilize the tines to stretch the carpet to be tight to eliminate the wrinkles. Therefore, the stretcher provides much convenience to the worker. However, the length of its handle is limitative and could not adjust. So as to cause difficulty to the worker who stands at a corner of the walls or at a place where the worker could not reach. Further, its head is too big to pack for collection. Besides, the height of the workers are not so similar to each other especially between a man and a woman that they are not substantially fitting the handle at all. In such a circumstance, he or she could not properly apply the strength.

SUMMARY OF THE PRESENT INVENTION

The present invention has a main object to provide a supplementary stretcher for laying carpet which has a flexible handle capable of adjusting the length of the stretcher to enable the head of the stretcher reaching to any where on the floor.

Another object of the present invention is to provide a supplementary stretcher for laying carpet in which the end of the handle is designed in accordance with the ergonomics and so as to fit any height of the men or women who squat to use their knees to operate the handle of the stretcher that saves their strength especially in changing the directions of the head.

Still another object of the present invention is to provide a supplementary stretcher for laying carpet in which the head is foldable and facilitates the user to carry or to pack for collection.

Further object of the present invention is to provide a supplementary stretcher for laying carpet in which the head is replaceable with a sucking disk that facilitate the worker to suck a tile to lay on a high place or a dead angle.

Accordingly, the supplementary stretcher of the present invention comprises generally a head with a plurality of tines on the bottom, a hollow interior handle pivoted to the head and having a detent means disposed therein for selectively positioning a sliding bar which has a plurality of serrations on underside engageable with the detent means and is slidable within the handle for adjusting the length of the handle and a push plate in cooperation with a soft plate connected to the free end of the sliding bar. Therefore the adjustable handle not only coinsides with the ergonomics but also fits to the height of men or women to conveniently work with their knees. Further, the head of the stretcher can be changing the directions to stretch the carpet at any dead corners. Besides, the head can be replaced with a sucking disk moving a tile to a high place.

The present invention will become more fully understood by reference to the following detailed description thereof when read in conjunction with the attached drawings.

DETAILED DESCRIPTION OF THE PREFERRED EMBODIMENT

Figure 1:
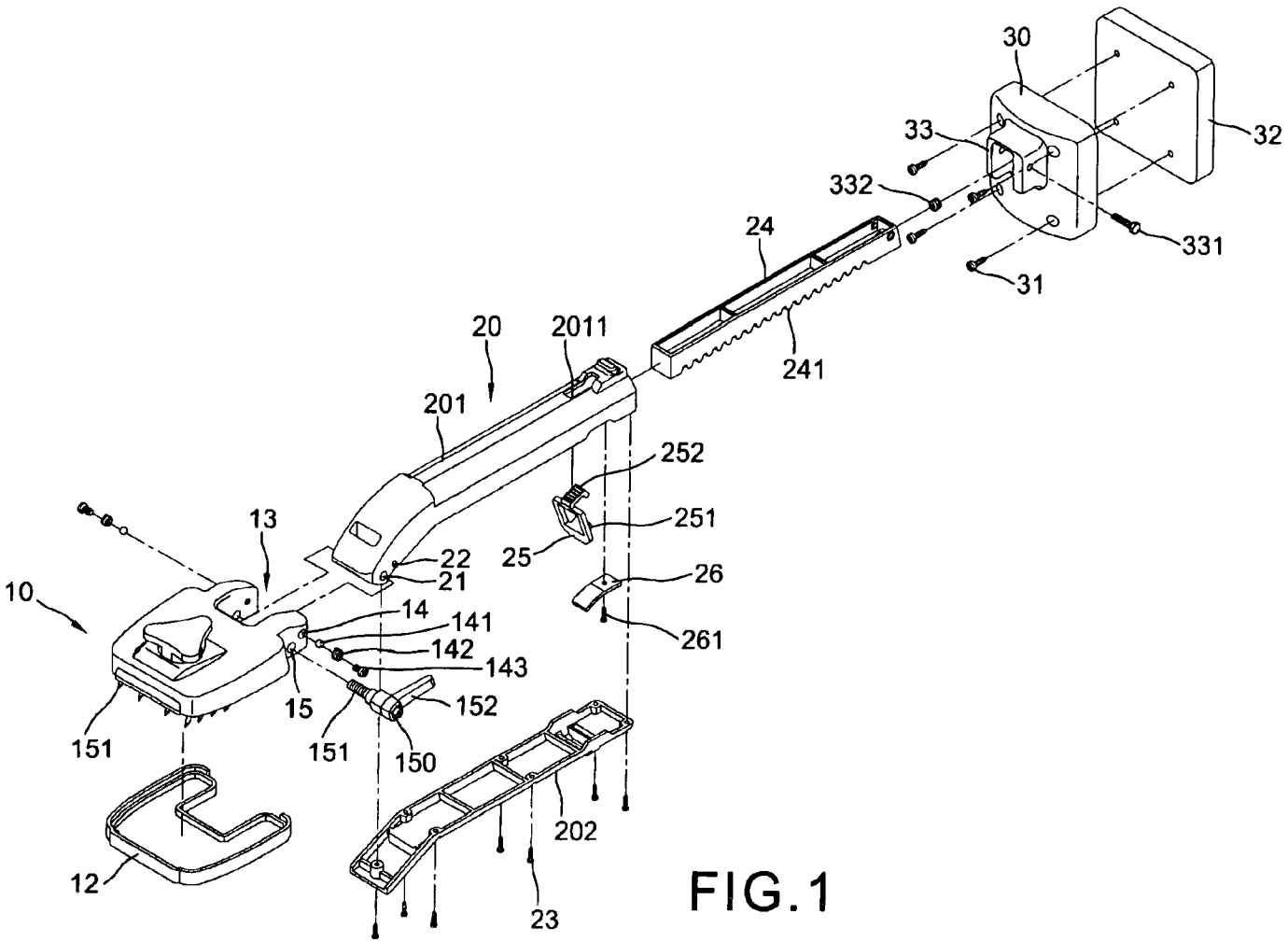
FIG. 1 is an exploded perspective view of the preferred embodiment of the supplementary stretcher of the present invention.
Figure 2:
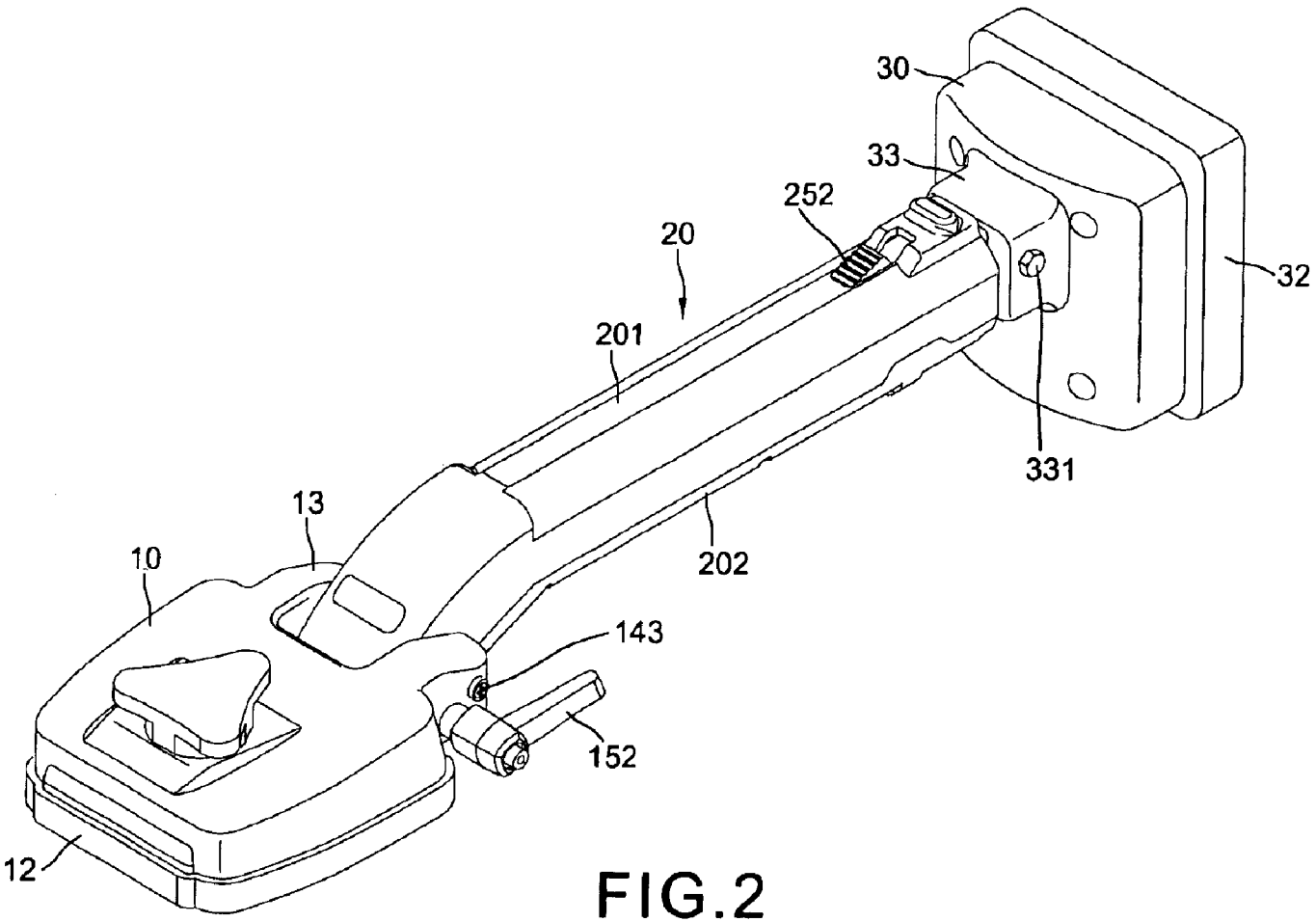
FIG. 2 is a perspective view to show the assembly of FIG. 1.
Figure 3:
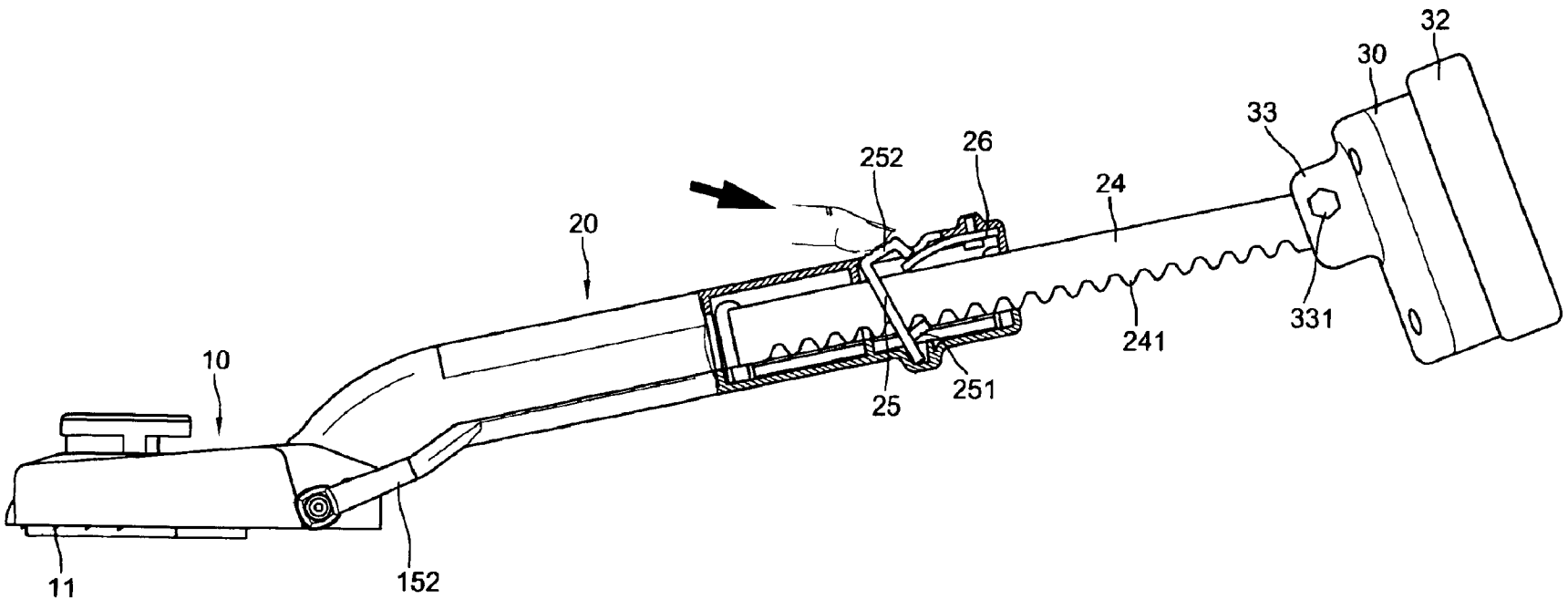
FIG. 3 is a sectional view indicating that the sliding bar is being pulling outward.
Figure 8:
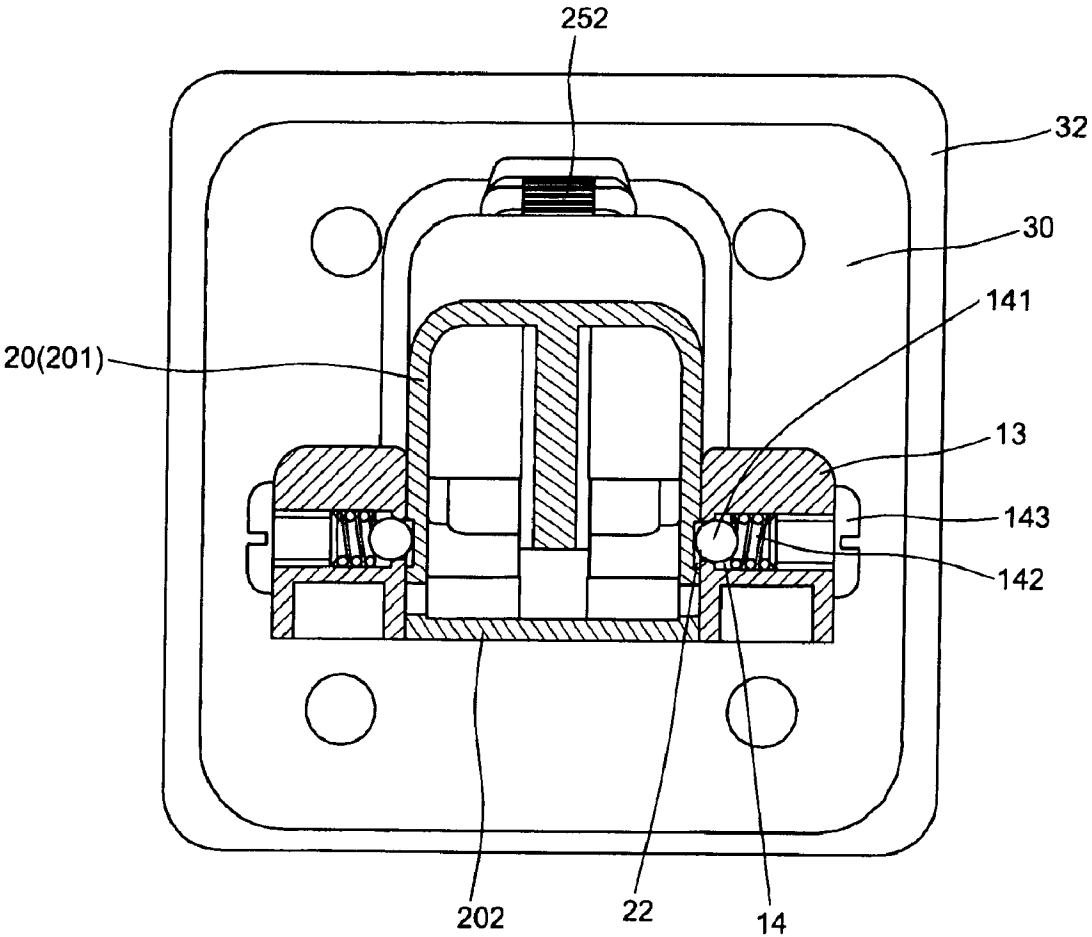
FIG. 8 is a sectional view indicating that steel balls are positioned at the pivotal portion.
Figure 9:
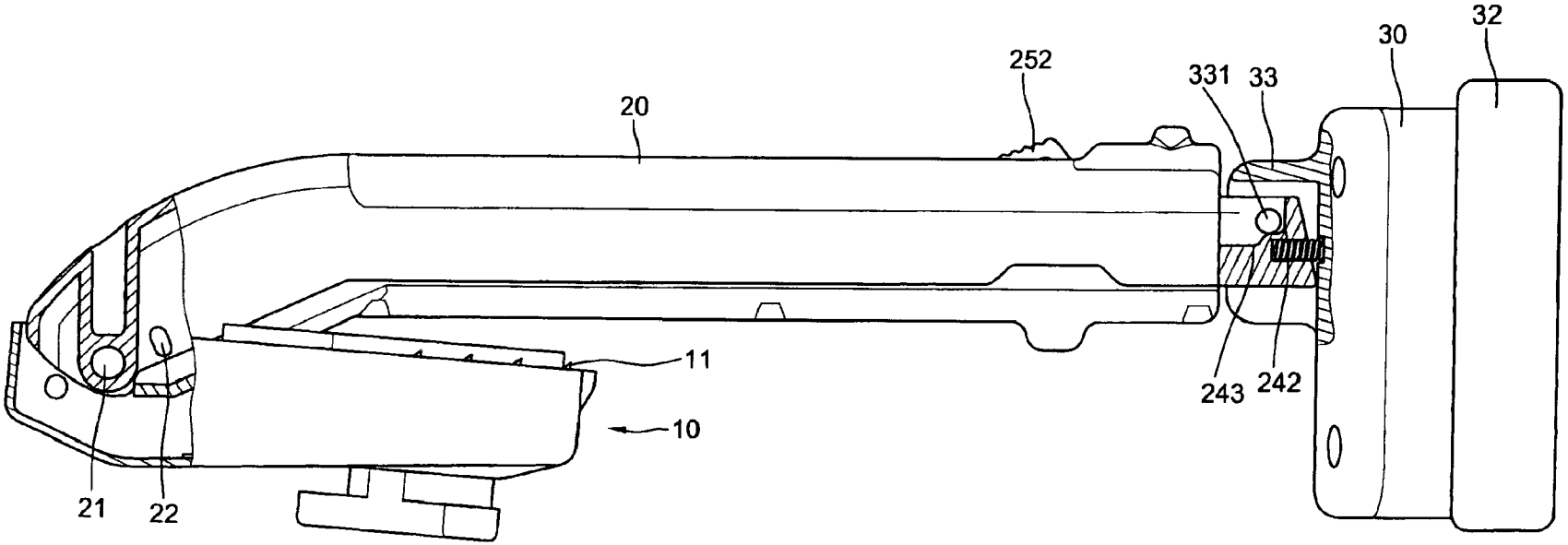
FIG. 9 is a plane view indicating the connection structure of the pushing plate with the sliding bar and the folded up head.

With reference to FIGS. 1 to 3 of the drawings, the preferred embodiment of the supplementary stretcher of the present invention comprises a flat head 10 having a plurality of tines 11 on underside and protected by a cap 12, a lug 13 on the rear side including a pair of aligned through holes 14 for disposing herein a pair of steel balls 141, a pair of springs 142 and a pair of screws 143 which close the outer end of the through holes 14 so that the springs 142 provide the elasticity to the steel balls, wherein the inner ends of the aligned through holes 14 has their diameter lesser than that of the steel balls 141 so as to prevent the steel balls 141 from escaped from the through holes 14 (as shown in FIG. 8), a pair of aligned screw holes 15 adjacent the aligned through holes 14, a hollow interior handle 20 having an upper portion 201, a bottom 202 connected by a plurality of screws 23, a downward arcuate front end engaged within the lug 13 of the head 10 including a pair of aligned pivotal holes 21 engaged with the aligned screw holes 15 and secured by a quickly applied lock 150 which has a threaded shank 151 screwed into the aligned screw holes 15 and the pivotal holes 21 and a lateral handle 152, a pair of positioning holes 22 engaged with the steel balls 141, a groove 2011 in a top adjacent the rear end of the upper portion 201 of the handle 20, a detent means 25 including a retaining frame 251 disposed in the rear portion of the handle 20 and a pressing plate 252 engaged within the groove 2011, an elastic plate 26 secured to an upper inner wall of the handle 20 by a screw 261 with a free end engaged with the pressing plate 252 for providing elasticity to the pressing plate 252, a sliding bar 24 slidably inserted into the rear end of the handle 20 having a plurality of serrations 241 on the underside retainable by the retaining frame 251 of the detent means 25, a pushing plate 30 connected with a soft plate 32 by a plurality of screw 31, an inverse U-shaped member 33 centrally formed on front surface including a pair of aligned screw holes engaged with a pair aligned through holes abutting the rear end of the sliding bar 24 and pivotally secured by a screw 331, wherein the inverse U-shaped member 33 further has a spring 332 on inner center connected the rear end of the sliding bar for providing the resilience to restore the pushing plate 30 back to its original position. The sliding bar 24 further has a pair of concaves 242 and 243 under the aligned through holes for saving material and for permitting the movement of the screw 331 (as shown in FIG. 9). This arrangement aims to facilitate the pushing plate 30 to incline a certain angle relative to the sliding bar 24 in order to fit the height of the knee of a worker to push the pushing plate 30 when he is squatted.

Figure 4:
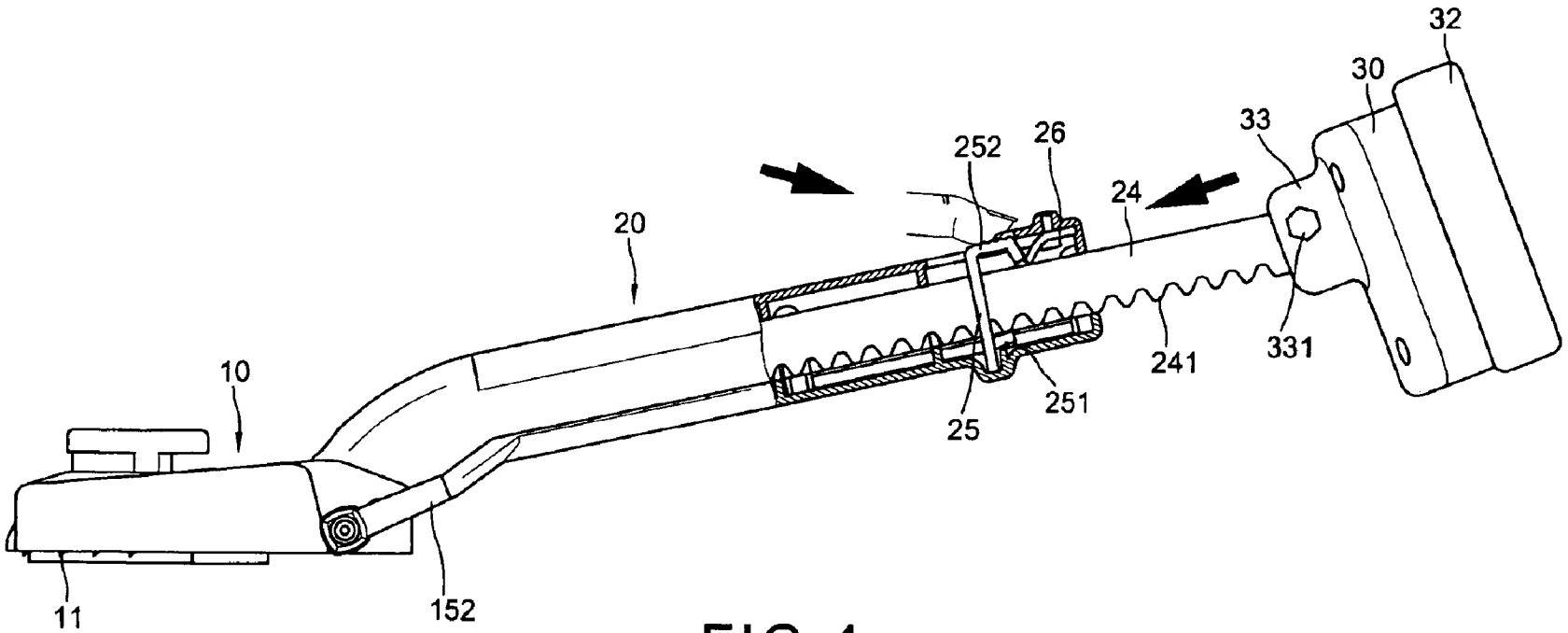
FIG. 4 is a sectional view indicating that the pressing plate is pressed down.
Figure 5:
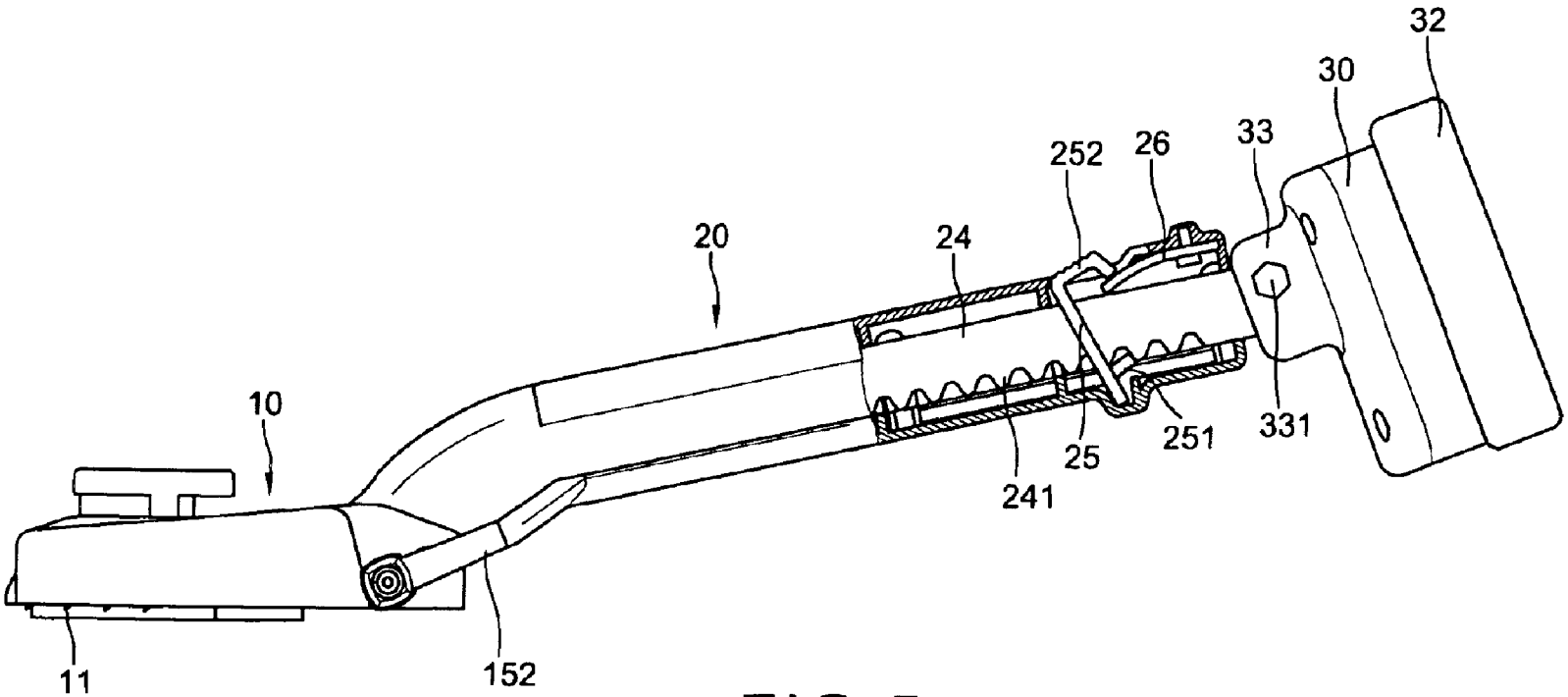
FIG. 5 is a sectional view indicating that the sliding bar is being pushed into the handle.

Referring to FIGS. 4 and 5 and FIG. 3 again, in operation, first adjust the length of the handle 20 by sliding in or out of the sliding bar 24, if slides the sliding bar 24 inward, one has to press the pressing plate 252 down and forward to straight the tilting retaining frame 251 to disengage the serrations 241 with the frame 251, then release the finger to restore the retaining frame back into its tilting state due to the resilience of the elastic plate 26 so that a serration 241 is retained by the retaining frame 251 again and the sliding bar 24 is becoming stable, if slides the sliding bar 24 outward, one don't have to press the pressing plate 252 due to the tilting state of the retaining frame 251 which is disengageable with the serrations 241 but gives forth a snapped sound, finally removes the cap 12, the stretcher is therefore operable.

Figure 6:
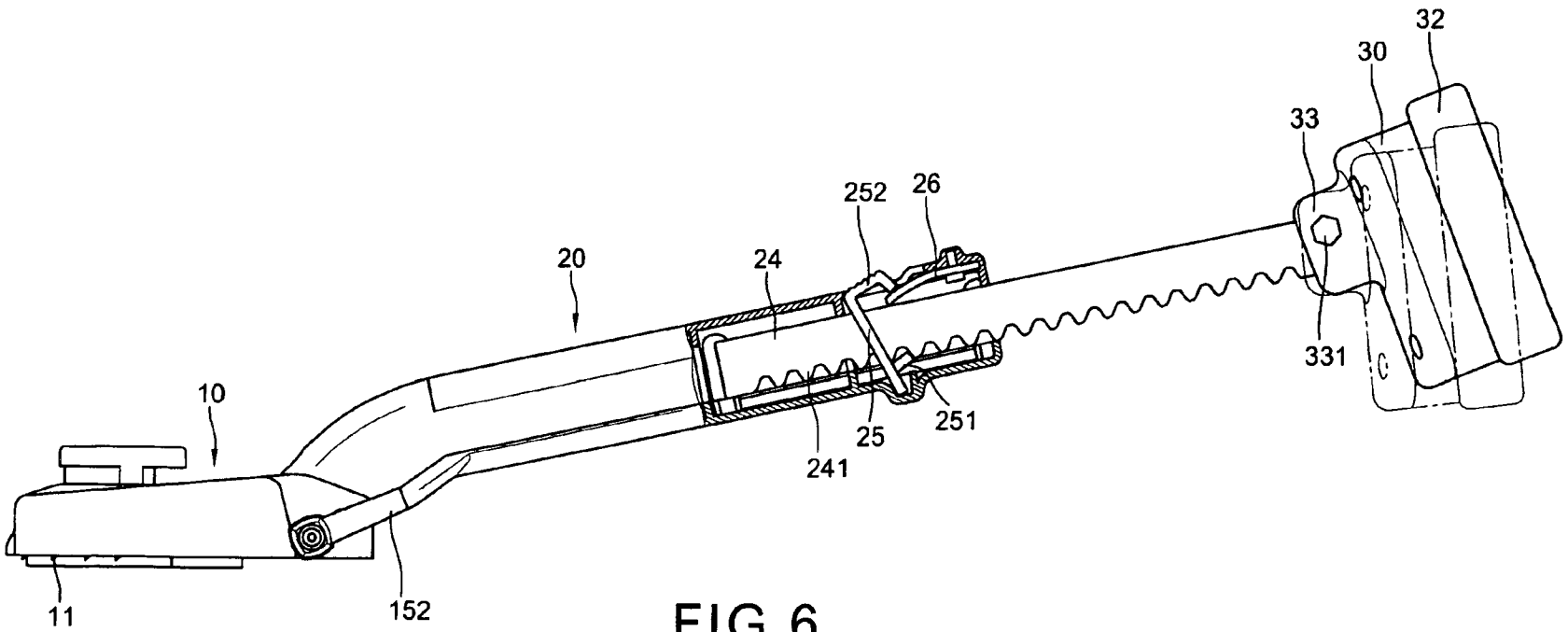
FIG. 6 is a sectional view indicating that the pushing plate is turned a certain angle relative to the plane of the sliding bar.
Figure 7:
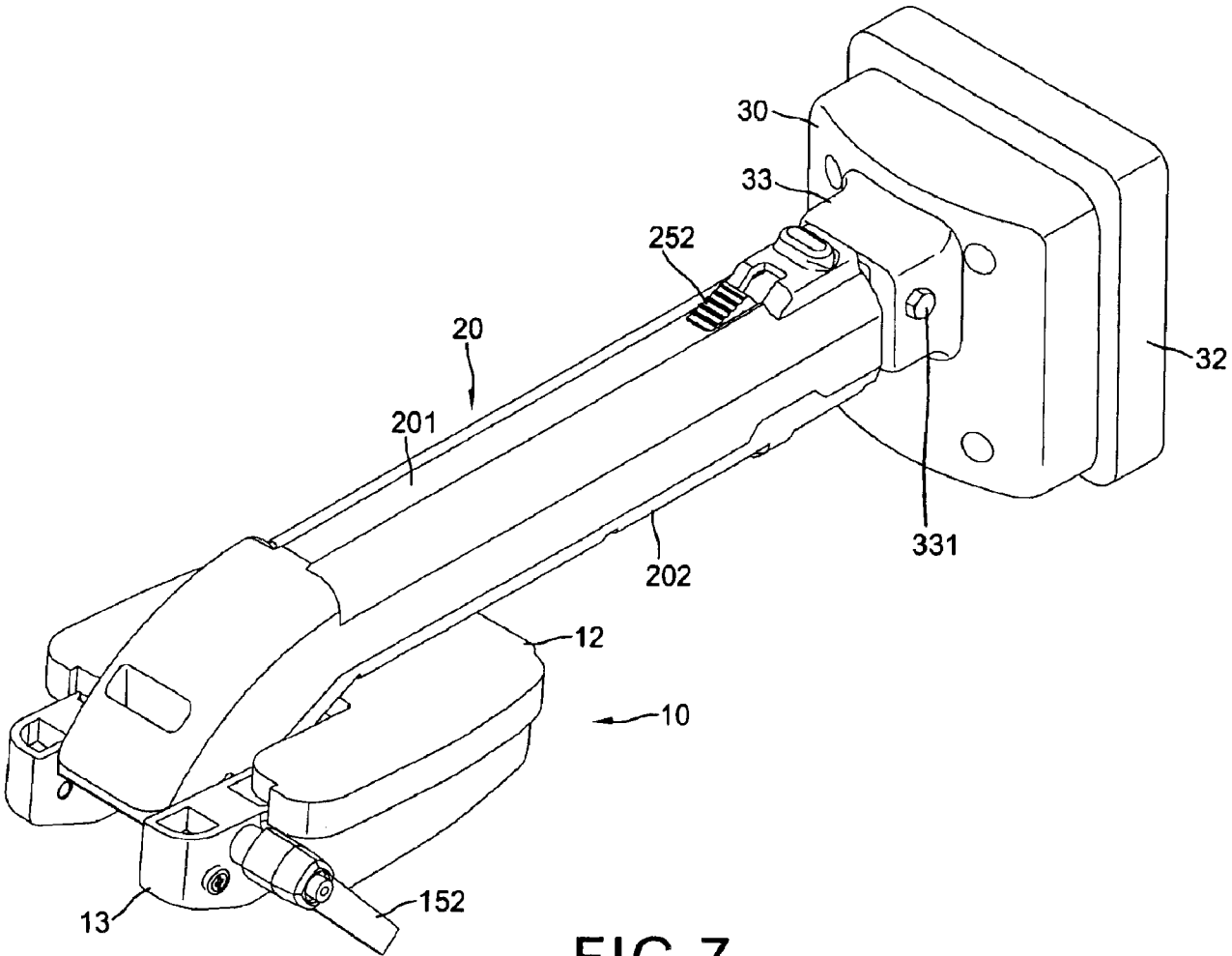
FIG. 7 is a perspective view indicating that the head is being folded up and positioned under the handle.

Referring to FIGS. 6 and 9, since the workers laying a carpet are usually squatted to use their knees to push the stretcher moving forward. In order to fit the height of the workers, men or women, the pair of concaves 242 and 243 are therefore arranged in the rear end of the sliding bar 24 to permit the screw 331 to be movable there within so as to enable the pushing plate 30 changing a certain angle. This arrangement not only coinsides with the ergonomics but also saves the application of the strength for the workers.

Referring to FIGS. 6, 7, 8 and 9, to coinside with the ergonomics, the head 10 of the stretcher may be positioned horizontal or turned a angle centered on the quickly applied lock 150. The pair of steel balls 141 ensure a stable straight position of the head 10. When the stretcher is not in use, slides the sliding bar 24 into the handle 20 at first then strongly bend the head 10 downward to have its positioning holes 22 disengaged with the steel balls 141. So that the head 10 is folded up under the handle 20 thus to reduce the volume of the stretcher.

Figure 10:
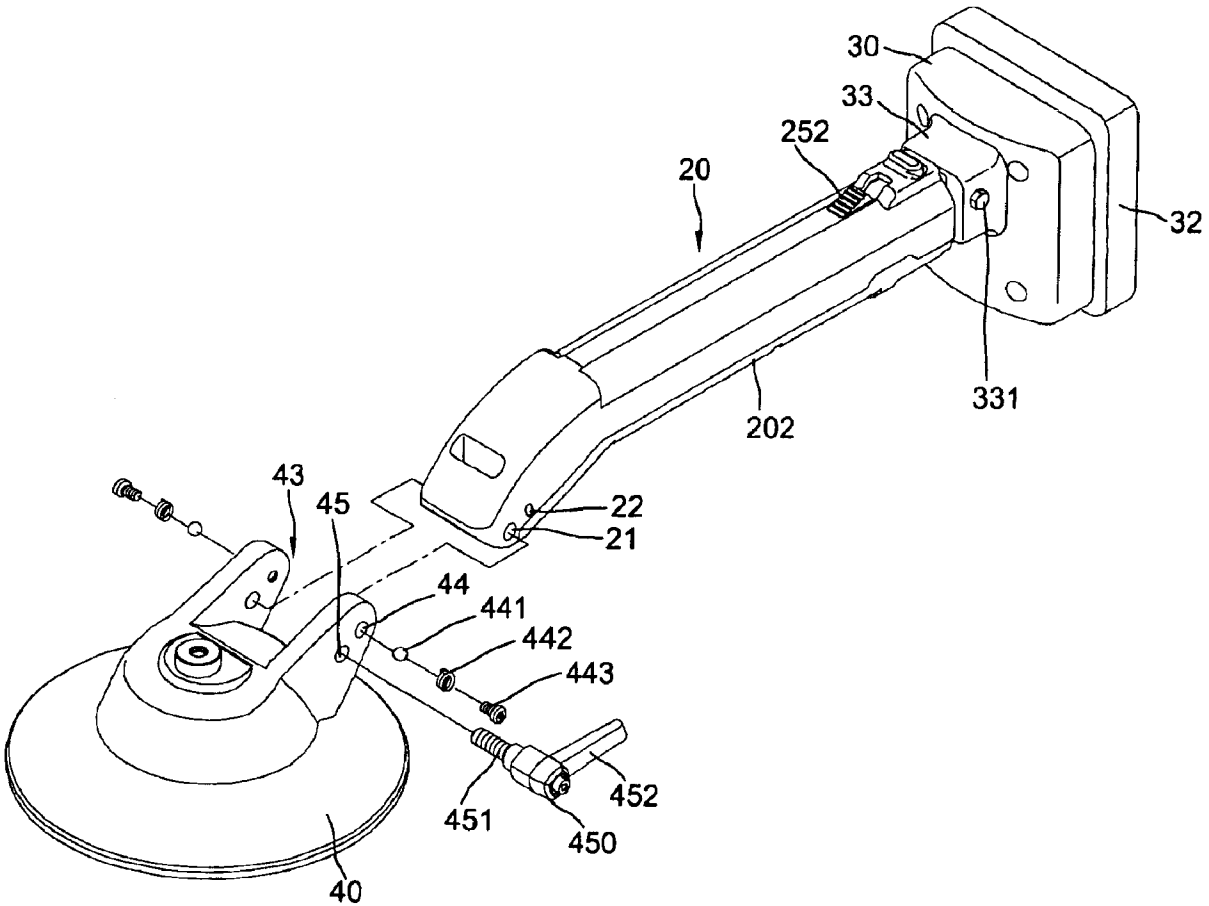
FIG. 10 is an exploded perspective view indicating that the head is replaceable with a sucking disk.
Figure 11:
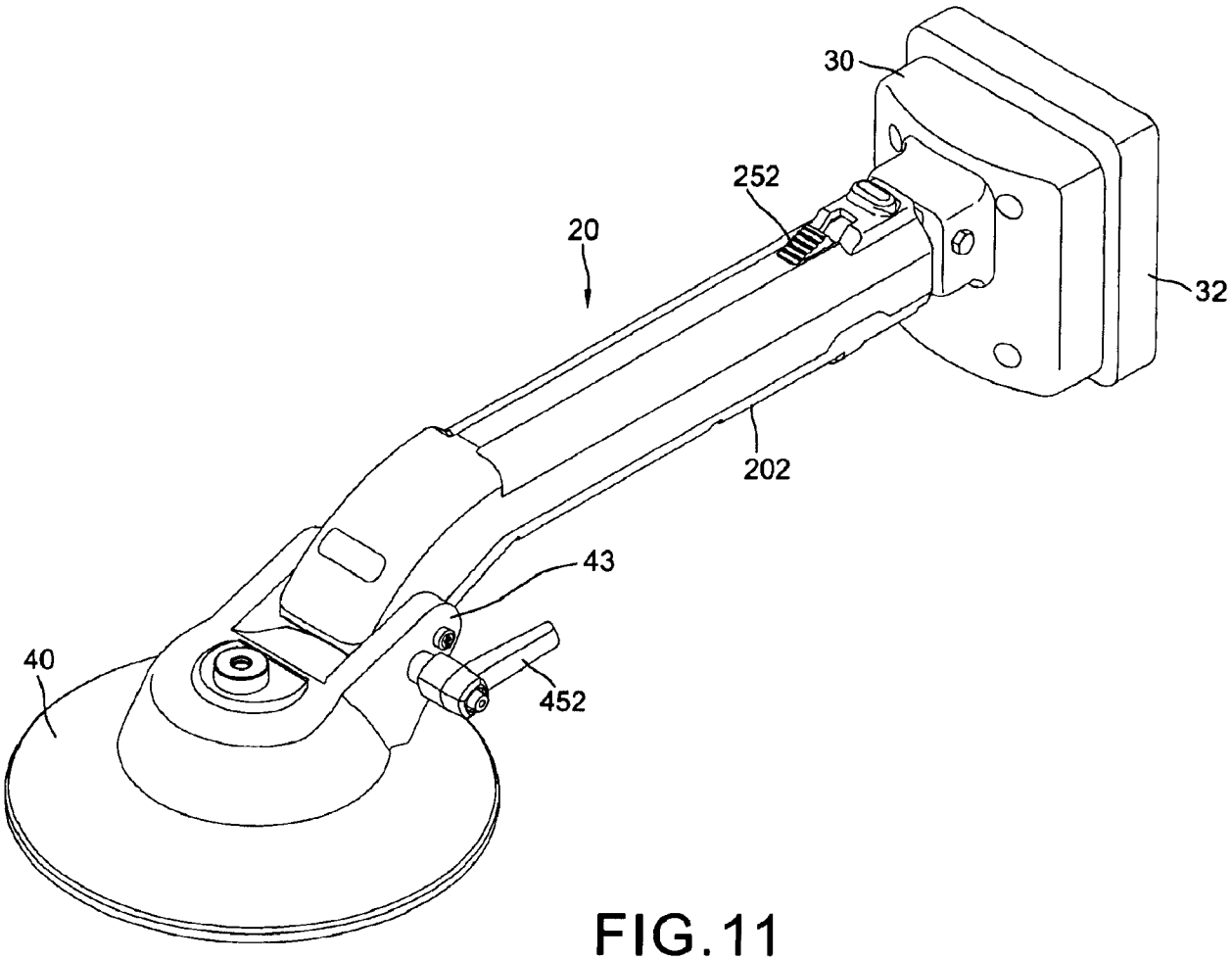
FIG. 11 is a perspective view indicating that the sucking disk is already connected with the front end of the handle.

Referring to FIGS. 10 and 11 of the drawings, the head 10 may be replaced with sucking disk 40 which has a lug 43 engaged with the front end of the handle 20. The lug 43 has also a pair of aligned through holes 44 engaged with the positioning holes 22 and a pair of aligned screw holes 45 engaged with the aligned pivotal holes 21. Wherein the aligned through holes 44 each has a steel ball 441, a spring 442 and a screw 443 disposed therein with the steel balls 441 partially engaged with the positioning holes 22 respectively. A quickly applied lock 450 has a threaded shank 451 screwed into the aligned screw holes 45 and the pivotal holes 21 and a lateral handle 452. This sucking disk 40 is useful to suck and move a piece of tile or glass to a high place where the worker is not accessable.

Upon the afore discussions, the supplementary stretcher of the present invention can either adjust the length for its handle 20 or change the angle for its head 10 and its pushing plate to fit the ergonomics in order to save the strength for the workers and the head 10 may be replaced with a sucking disk 40 which is suitable to work for moving the tiles and/or the glasses to a high place.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A supplementary stretcher for laying carpet comprising:

a flat head having a plurality of tines on the underside protected by a cap thereon and a lug on the rear end including a pair of aligned through holes and a pair of aligned screw holes wherein said aligned through holes each having a steel ball and a first spring disposed therein secured by a bolt;

a hollow interior handle having an upper portion and a lower portion secured to the upper portion by a plurality of screws, said handle having a pair of pivotal holes and a pair of positioning holes spacedly formed in a downward arcuate front end respectively engaged with the screw holes and the through holes of said lug and movably secured by the pair of steel balls and a quickly applied lock which has a threaded shank screwed into the aligned screw holes of said lug and the pivotal holes of said handle and a lateral handle thereof, a groove in a top of said handle adjacent the rear end thereof, a detent means disposed in said handle under said groove having a retaining frame and a pressing plate on a top engaged within said groove, an elastic plate having one end secured to a top inner wall by a screw and another end engaged with said pressing plate;

a sliding bar slidably inserted into the rear end of said handle through the retaining frame of said detent means having a plurality of serrations on underside engageable with said retaining frame and a pair of aligned through holes adjacent rear end thereof;

a pushing plate connected with a soft plate on outer surface secured by a plurality of screws and having an inverse U-shaped member centrally formed on inner side including a pair of aligned screw holes in lateral walls engaged with the aligned through holes of said sliding bar and pivotally secured by a screw with a spring engaged therebetween.

2. The supplementary stretcher as recited in claim 1, wherein said through holes of said aligned lug have their inner ends diametrically lesser than that of said steel balls.

3. The supplementary stretcher as recited in claim 1, wherein said flat head and said pushing plate may be slanted a certain angle.

4. The supplementary stretcher as recited in claim 1, wherein said flat head is foldable.

5. The supplementary stretcher as recited in claim 1, wherein said handle is lengthily adjustable.

6. The supplementary stretcher as recited in claim 1, wherein said flat head is replaceable with a sucking disk.

* * * * *